US005771995A

United States Patent [19]

Cooney et al.

[11] Patent Number: 5,771,995

[45] Date of Patent: Jun. 30, 1998

[54] LOCKING ELEVATOR CAR FRAME TO BUILDING DURING LOADING/UNLOADING HORIZONTALLY MOVEABLE CAB

[75] Inventors: Anthony Cooney, Unionville; Frederick H. Barker, Bristol; Bruce A. Powell, Canton; Samuel C. Wan, Simsbury; Paul Bennett, Waterbury; Richard C. McCarthy, Simsbury; Joseph Bittar, Avon, all of Conn.

[73] Assignee: Otis Elevator Company, Farmington, Conn.

[21] Appl. No.: 565,648

[22] Filed: Nov. 29, 1995

[51] Int. Cl.[6] ..... B66B 5/16

[52] U.S. Cl. ..... 187/357; 187/356

[58] Field of Search ..... 187/357, 356; 70/280; 292/144

[56] References Cited

U.S. PATENT DOCUMENTS

| | | | |
|---|---|---|---|
| 1,027,229 | 5/1912 | Yetter | 187/357 |
| 1,152,318 | 8/1915 | Howarth | 187/357 |
| 1,347,157 | 7/1920 | Hanson | 292/144 |
| 1,359,641 | 11/1920 | Williams | 187/357 |
| 1,939,729 | 12/1933 | Stark | 187/1 |
| 3,434,609 | 3/1969 | Bosworth et al. | 214/95 |
| 4,799,719 | 1/1989 | Wood | 292/144 |
| 4,986,099 | 1/1991 | Johnson et al. | 292/144 |
| 5,546,777 | 8/1996 | Liu et al. | 292/144 |

FOREIGN PATENT DOCUMENTS

| | | | |
|---|---|---|---|
| 10120A | 11/1901 | Norway | 187/357 |

*Primary Examiner*—William E. Terrell
*Assistant Examiner*—Khoi H. Tran

[57] ABSTRACT

To prevent elevator rope stretch effects when a horizontally transferable elevator cab (18) is rolled onto and off of an elevator car frame (10), an elevator car/floor lock (31) includes a bolt (37) which extends across the interface between the car frame and the building and engages a strike (39). Jack screw (44) and solenoid (60) embodiments are shown. The bolt may extend from the car frame to the building (FIGS. 1–4) or from the building to the car frame (FIG. 5).

21 Claims, 2 Drawing Sheets

LOCKING ELEVATOR CAR FRAME TO BUILDING DURING LOADING/UNLOADING HORIZONTALLY MOVEABLE CAB

TECHNICAL FIELD

This invention relates to a lock for firmly locking an elevator car frame to a building whenever a horizontally moveable elevator cab may be moved onto or off of the car frame.

BACKGROUND ART

The sheer weight of the rope in the hoisting system of a conventional elevator limits their practical length of travel. To reach portions of tall buildings which exceed that limitation, it has been common to deliver passengers to sky lobbies, where the passengers walk on foot to other elevators which will take them higher in the building. However, the milling around of passengers is typically disorderly, and disrupts the steady flow of passengers upwardly or downwardly in the building.

All of the passengers for upper floors of a building must travel upwardly through the lower floors of the building. Therefore, as buildings become higher, more and more passengers must travel through the lower floors, requiring that more and more of the building be devoted to elevator hoistways (referred to as the "core" herein). Reduction of the amount of core required to move adequate passengers to the upper reaches of a building requires increases in the effective usage of each elevator hoistway. For instance, the known double deck car doubled the number of passengers which could be moved during peak traffic, thereby reducing the number of required hoistways by nearly half. Suggestions for having multiple elevator cars moving in hoistways have included double slung systems in which a higher cab moves twice the distance of a lower cab due to a roping ratio, and elevators powered by linear induction motors (LIMs) on the sidewalls of the hoistways, thereby eliminating the need for roping. However, the double slung systems are useless for shuttling passengers to sky lobbies in very tall buildings, and the LIMs are not yet practical, principally because, without a counterweight, motor components and energy consumption are prohibitively large.

In order to reach longer distances, an elevator cab may be moved in a first car frame in a first hoistway, from the ground floor up to a transfer floor, moved horizontally into a second elevator car frame in a second hoistway, and moved therein upwardly in the building, and so forth, as disclosed in U.S. Pat. No. 5,657,835. Since the loading and unloading of passengers takes considerable time, in contrast with high speed express runs of elevators, another way to increase hoistway utilization, thereby decreasing core requirements, includes moving the elevator cab out of the hoistway for unloading and loading, as is described in a commonly owned, copending U.S. patent application Ser. No. 08/564,534, filed contemporaneously herewith.

When an elevator cab is removed from a car frame, the stretch in the roping system, particularly at lower floors, may be sufficient to snap the elevator car frame upwardly. Thus, perturbations could be put into the system and damage done to various components of the elevator and/or the building. Similarly, if an empty car frame is brought to a landing and a cab is loaded thereon, the loading of the first portion of the cab may stretch the roping sufficiently to lower the car frame an impermissible amount below the landing, prior to the cab being fully loaded thereon.

DISCLOSURE OF INVENTION

Objects of the invention include locking an elevator car frame to a building to permit loading and unloading of elevator cabs without rope stretch effects.

According to the present invention, solenoid operated bolts on one side of the interface of a car frame with a landing engage a strike on the other side of the interface. According to the invention, the locks are bistable, remaining in whichever position (locked or retracted) they are placed until positively moved to the other position by the solenoid. According further to the invention, load cells and/or strain gages provide a measure of the load on the locks. The bolts may be disposed on the car frames or on the buildings, with the strikes disposed on the building or the car frames.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
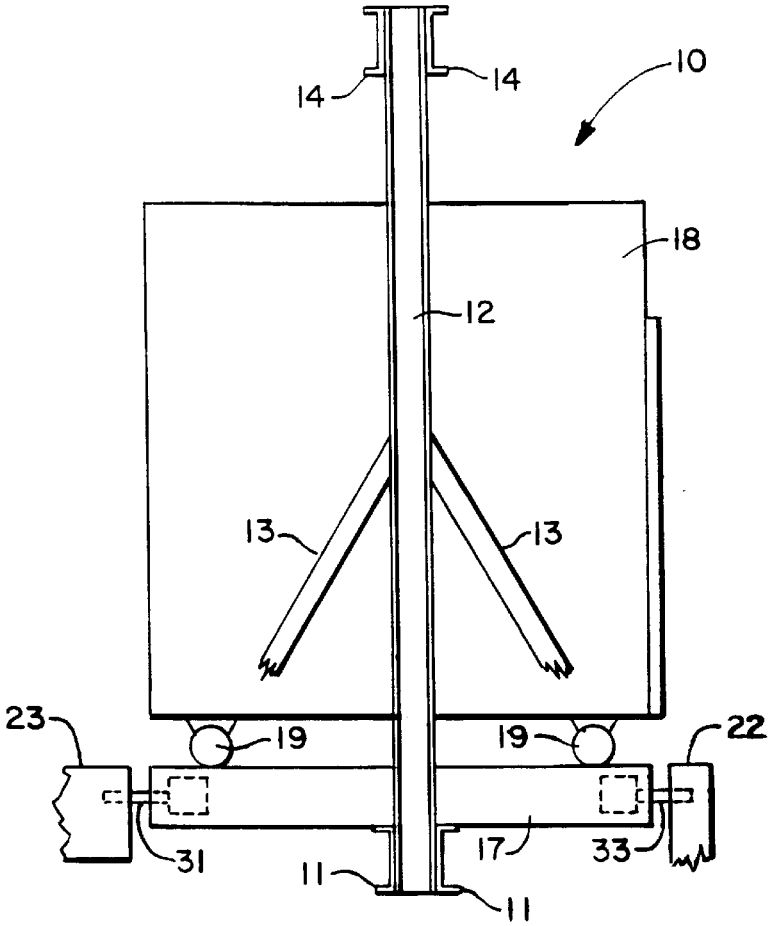
FIG. 1 is a simplified, side elevation view of an elevator car frame carrying a horizontally moveable cab, with car/floor locks of the invention engaged.
Figure 2:
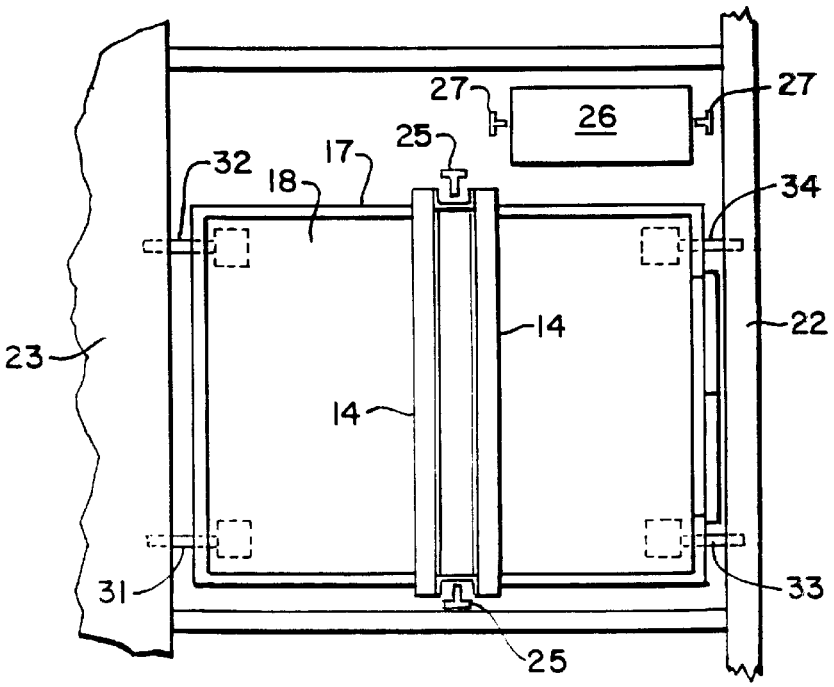
FIG. 2 is a simplified top plan view of the elevator car frame and cab of FIG. 1.

Referring now to FIG. 1, an elevator car frame 10 may include a plank 11, stiles 12 with braces 13 (which have been broken away for visibility), and a crosshead 14, all in the usual fashion. A platform 17 is supported by the plank 11 and the braces 13, and carries an elevator cab 18 which can be rolled on and off the elevator frame 10 by means of rollers or wheels 19. As disclosed in a commonly owned, copending U.S. application Ser. No. 08/564,534, filed contemporaneously herewith, the elevator cab 18 may be slidable from the platform 17 of one car frame across a sill 22 to another, similar car frame disposed to the right of that shown in FIG. 1, or it may be rolled to or from a landing 23 at a suitable floor of a building, for the purpose of transferring passengers, or otherwise. As seen in FIG. 2, the elevator car frame 10 moves vertically between guide rails 25, adjacent to a counterweight 26 which moves in the opposite direction between similar guide rails 27, all in the well-known way. The remaining elevator structure is conventional, and is not shown.

According to the invention, the elevator car frame 10 is locked rigidly in place by a plurality of car/floor locks 31–34, which extend across the interface between the platform 17 and either the sill 22 or the landing 23. The locks prevent movement of the car frame 10 and whipping of the support ropes as a consequence of a significant change in the weight being supported by the ropes, as the cab 18 is removed from the car frame, particularly when another cab does not simultaneously replace it, as is the case in said co-pending application Ser. No. 08/564,534.

Figure 3:
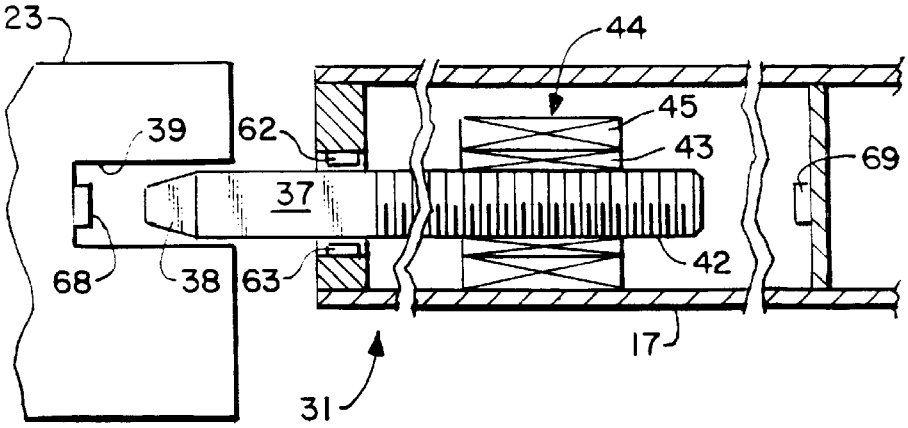
FIG. 3 is a partial, partially sectioned, side elevation view of a first embodiment of a car/floor lock of FIG. 1.

In FIG. 3, a car/floor lock according to a first embodiment of the invention may be disposed in any suitable way within the platform 17. In this embodiment, the bolt 37 of the lock consists of a square steel shaft which has its distal end 38 tapered on all four sides, to facilitate insertion of the bolt into a strike 39 formed in the structure of the landing 23 (in the case of the car/floor bolts 31, 32, or in the sill 22 in the case of the car/floor bolts 33, 34). The bolt 37 is formed integrally (or otherwise) with a threaded shaft 42 which engages the internal threads of a hollow rotor 43 of an electric motor 44 that includes a stator 45. The shaft 43 and motor 44 comprise a well-known jack screw. Typically, current in one polarity will cause rotation of the rotor in a direction to cause the bolt 37 to extend outwardly toward the strike 39, whereas current in the opposite direction will cause rotation of the rotor 43 so as to cause the bolt 37 to retract wholly within the platform 17. The bolt 37 always remains where it was last positioned, even during power failure.

Figure 4:
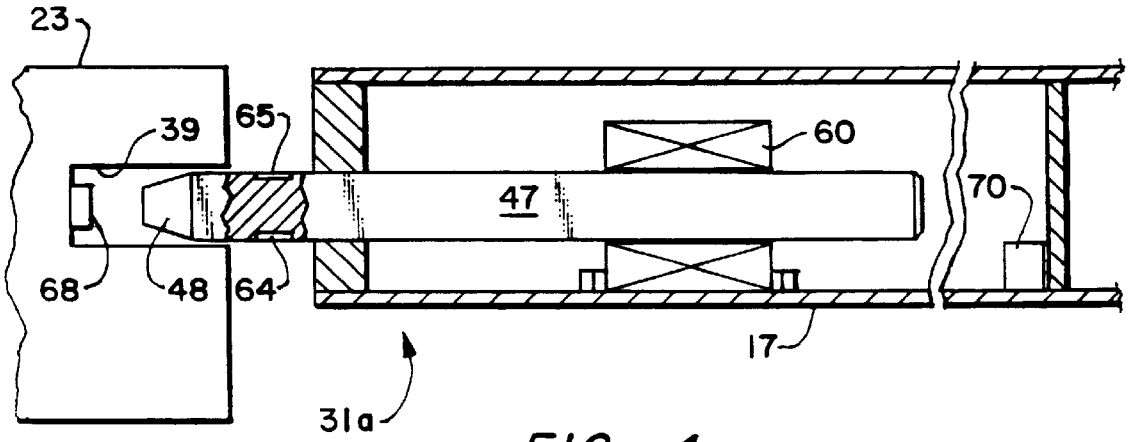
FIG. 4 is a partial, partially sectioned, side elevation view of a second embodiment of a car/floor lock of FIG. 1.

In FIG. 4, a bolt 47 of a car/floor lock 31*a* has a similarly tapered end 48 to facilitate entry into the strike 39. The bolt 47 is made of magnetic material, magnetized with one end a north pole and the other end a south pole. A solenoid 60 will cause the bolt 47 to extend leftwardly (as seen in FIG. 4) so that its distal end 48 will enter the strike 39, as shown, in response to current of one polarity; it will retract the bolt in response to current of the opposite polarity. As shown, the bolt 47 has not been extended to its full leftward position. When power is removed from the solenoid 60, the bolt 47 will remain where it was. In this embodiment, therefore, loss of power or other failure will not result in the car/floor locks becoming either engaged or retracted.

As described in a commonly owned co-pending U.S. patent application, Ser. No. 08/564,028, filed contemporaneously herewith, in order to pretorque the elevator motor, so that the motor is holding the entire weight of the elevator car prior to retracting the car/floor locks 31–34, some means is required to determine the weight or strain on the car/floor locks 31–34 during the pretorque procedure. In the embodiment of FIG. 3, load cells 62, 63 are disposed on the platform above and below the bolt 37 so as to provide a measure of the net weight of the elevator car. The load cells 62, 63 may be operated differentially, and a convention may be chosen (for illustrative purposes herein) that excess weight on the load cell 62 will provide a positive signal resulting in positive armature current during pretorque whereas a light cab will result in force applied to the cell 63 which yields a negative signal to result in negative armature current (or less torque in another fashion) in balancing the cab during the pretorque process. This is as described in said application Ser. No. 08/564,028.

An alternative means of providing a measure of car/counterweight weight differential may comprise differentially connected strain gages 64, 65 illustrated in FIG. 4. These may be embedded in the bolt 47 so as to permit the bolt to slide horizontally without interference, as shown. A similar convention can be taken so that if the bolt 47 bends concave downwardly, as a result of excess car weight, the differential signal from the strain gages 64, 65 will be positive, resulting in positive armature current in the pretorque car leveling process, and bending of the bolt 47 concave upwardly would result in negative signals and armature current. Of course, the load cells 62, 63 can be used with the bolt 47 rather than the strain gages 64, 65, and the strain gages 64, 65 may be embedded in the bolt 37, eliminating the need for the load cells 62, 63. Or, both load cells 62, 63 and strain gages 64, 65 can be used with either of the bolts 37, 47, if desired. On the other hand, other means may be utilized to provide a measure of car frame loading, and other means may be utilized to cause the bolts to engage the strike and to retract, as desired.

In order to determine when the locks are safely engaged, a microswitch 68 may be provide the base of the strike 39. Similarly, as seen in FIG. 3, a microswitch 69 may be provided at the extreme retracted position of the shaft 42. Alternatively, as seen in FIG. 4, a proximity detector 70 might be provided at the extreme retracted position of the shaft 55. Other ways may be chosen to provide means for detecting the position of the car/floor locks 31–34, in their fully locked and fully retracted positions, respectively.

Figure 5:
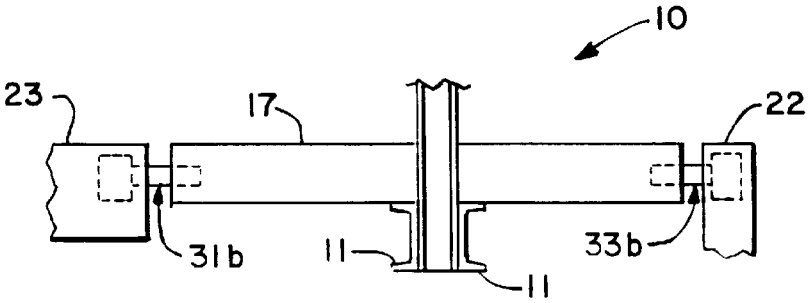
FIG. 5 is a partial, simplified side elevation view of an elevator car frame with car/floor locks of an alternative embodiment of the invention engaged.

The present invention has been disclosed in an embodiment which includes one set of car/floor locks 31–34 disposed on an elevator car frame. This requires that only the strike 39 for each lock be provided at any floors where cab transfers can take place, which generally is only at one or both ends of a hoistway (rather than at many floors in between). The embodiment disclosed therefore requires fewer car/floor locks 31–34 than would be required if transfer of the cab could take place at both ends of the shaft and the locks were provided on the shaft rather than on the car frame. On the other hand, car frame weight and complexity can be reduced by mounting the car/floor locks 31–34 on the building steel in the hoistway and providing the corresponding strikes in the car frame, as illustrated briefly in FIG. 5. The second embodiment reduces the power requirements on the car frame 10, and the signals required to be carried to and from the car frame 10, typically by a traveling cable. However, if the elevator may transfer cabs at a large number of stops, then the embodiments of FIGS. 1–4 may be preferable to that of FIG. 5.

In FIGS. 1 and 2, the bolts are shown being at the interface at the front of the elevator, and at the rear of the elevator. Where the elevator cab is being rolled across the interface at the front or at the rear, or both, placing the locks on the front and rear interfaces is to be preferred. However, in any embodiment where desired or necessary, the locks may be provided on the sides of the elevator car frame if suitable structure is provided therefor, or may be provided on all sides. All this is irrelevant to the present invention. Similarly, the load cells 62, 63 may be disposed within the strike 39 in either the embodiments of FIGS. 1–3, or the embodiment of FIG. 5.

All of the aforementioned patent applications filed contemporaneously herewith are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A car floor lock for locking an elevator car frame to a floor landing of a building when said car frame is disposed at said landing, said lock spanning an interface having two sides between said car frame and a structure in an elevator hoistway at said landing, said lock comprising:

a bolt disposed to extend horizontally from a first side of said interface to span said interface;

a strike on the other side of said interface for receiving said bolt when it is extended, engagement of said bolt with said strike preventing relative vertical motion between said elevator car frame and said structure;

means for selectively extending said bolt into said strike or, alternatively, retracting said bolt so as to be clear of interface; and means for sensing upward or downward force exerted between said bolt and said strike and providing a signal indicative of the magnitude and direction thereof.

2. A lock according to claim 6 wherein said means for selectively extending comprises:

a jack screw operable in either one of two horizontal directions, having a threaded shaft connected to said bolt, operation of said jack screw in a first one of said directions extending said bolt into said strike, and operation of said jack screw in a second one of said directions retracting said bolt so as to be clear of said interface.

3. A lock according to claim 1 wherein:

said bolt is magnetized; and said operating means comprises a solenoid, the armature of which is said bolt, energization of said solenoid with current of a first polarity extending said bolt into said strike, and energization of current in an opposite polarity retracting said bolt into a fully retracted position clear of said interface.

4. A lock according to claim 1 further comprising:

means for sensing the engagement of said bolt with said strike and providing a signal indicative thereof.

5. A lock according to claim 1 further comprising:

means for sensing the retraction of said bolt clear of said interface and providing a signal indicative thereof.

6. A lock according to claim 1 wherein said sensing means comprises a load cell.

7. A lock according to claim 6 wherein said sensing means comprises a pair of load cells for sensing both upward and downward force on said bolt.

8. A lock according to claim 1 wherein said sensing means comprises a strain gage.

9. A lock according to claim 8 wherein said sensing means comprises a pair of strain gages differentially connected to opposite surfaces of said bolt.

10. A lock according to claim 6 wherein said bolt is disposed on said car frame and said strike is disposed on said structure.

11. A lock according to claim 6 wherein said bolt is disposed on said structure and said strike is disposed on said car frame.

12. A car floor lock for locking an elevator car frame to a floor landing of a building when said car frame is disposed at said landing, said lock spanning an interface between said car frame and a structure in an elevator hoistway at said landing, said lock comprising:

a plurality of bolts disposed on said car frame, each disposed to extend horizontally to span said interface;

a plurality of strikes, one for each of said bolts, each disposed in said structure on the other side of said interface from the related bolt, for receiving said related bolt when it is extended, engagement of said related bolt with each of said strikes preventing relative vertical motion between said elevator car frame and said structure;

a plurality of operating means, one for each of said bolts, each for selectively extending the corresponding one of said bolts into the related strike or, alternatively, retracting said corresponding bolt so as to be clear of said interface; and means for sensing upward or downward force exerted between said bolt and said strike and providing a signal indicative of the magnitude and direction thereof.

13. A lock according to claim 12 wherein each of said operating means comprises:

a jack screw operable in either one of two horizontal directions, having a threaded shaft of connected to said bolt, operation of said jack screw in a first one of said directions extending said bolt into said strike, and operation of said jack screw in a second one of said directions retracting said bolt so as to be clear of said interface.

14. A lock according to claim 12 wherein:

said bolt is magnetized; and said operating means comprises a solenoid, the armature of which is said bolt, energization of said solenoid with current of one polarity extending said bolt into said strike and energization of said solenoid with current of opposite polarity moving said bolt into a fully retracted position clear of said interface.

15. A lock according to claim 12 further comprising:

means for sensing the engagement of said bolt with said strike and providing a signal indicative thereof.

16. A lock according to claim 12 further comprising:

means for sensing the retraction of said bolt clear of said interface and providing a signal indicative thereof.

17. A car floor lock for locking an elevator car frame to a floor landing of a building when said ar frame is disposed at said landing, said lock spanning an interface between said car frame and a structure in an elevator hoistway at said landing, said lock comprising:

a plurality of bolts disposed on said structure, each disposed to extend horizontally to span said interface;

a plurality of strikes, one for each of said bolts, each disposed on said car frame on the other side of said interface from the related bolt for receiving said bolt when it is extended, engagement of said related bolt with each of said strikes preventing relative vertical motion between said elevator car frame and said structure;

a plurality of operating means, one for each of said bolts, each for selectively extending the corresponding one of said bolts into the related strike or, alternatively, retracting said corresponding bolt so as to be clear of said interface; and means for sensing upward or downward force exerted between said bolt and said strike and providing a signal indicative of the magnitude and direction thereof.

18. A lock according to claim 17 wherein said operating means comprises:

a jack screw operable in either one of two horizontal directions, having a threaded shaft of connected to said bolt, operation of said jack screw in a first one of said directions extending said bolt into said strike, and operation of said jack screw in a second one of said directions retracting said bolt so as to be clear of said interface.

19. A lock according to claim 17 wherein:

said bolt is magnetized; and said operating means comprises a solenoid, the armature of which is connected to said bolt, energization of said solenoid extending said bolt into said strike or alternatively urging said bolt into a retracted position clear of said interface, depending on the polarity of current flow through said solenoid.

20. A lock according to claim 17 further comprising:

means for sensing the engagement of said bolt with said strike and providing a signal indicative thereof.

21. A lock according to claim 17 further comprising:

means for sensing the full retraction of said bolt clear of said interface and providing a signal indicative thereof.

* * * * *